US009218776B2

(12) United States Patent
Jeon et al.

(10) Patent No.: US 9,218,776 B2
(45) Date of Patent: Dec. 22, 2015

(54) DISPLAY DEVICE

(71) Applicant: Samsung Display Co., Ltd., Yongin, Gyeonggi-Do (KR)

(72) Inventors: ByungKil Jeon, Asan-si (KR); Yong-Bum Kim, Suwon-si (KR); Dong-Hyun Yeo, Yongin-si (KR); Suhyun Jeong, Gwangju-si (KR); Heebum Park, Seongnam-si (KR); Junpyo Lee, Asan-si (KR)

(73) Assignee: Samsung Display Co., Ltd. (KR)

( * ) Notice: Subject to any disclaimer, the term of this patent is extended or adjusted under 35 U.S.C. 154(b) by 87 days.

(21) Appl. No.: 13/949,112

(22) Filed: Jul. 23, 2013

(65) Prior Publication Data

US 2014/0118331 A1 May 1, 2014

(30) Foreign Application Priority Data

Oct. 30, 2012 (KR) ..... 10-2012-0121537

(51) Int. Cl.
*G09G 5/00* (2006.01)
*G09G 3/36* (2006.01)

(52) U.S. Cl.
CPC ..... *G09G 3/3614* (2013.01); *G09G 3/3677* (2013.01); *G09G 2320/0233* (2013.01); *G09G 2320/0247* (2013.01)

(58) Field of Classification Search
USPC ..... 345/213, 204, 173, 691, 94, 208, 92, 345/211; 348/731
See application file for complete search history.

(56) References Cited

U.S. PATENT DOCUMENTS

| | | | | |
|---|---|---|---|---|
| 8,159,446 | B2 | 4/2012 | Lee et al. | |
| 8,179,392 | B2 | 5/2012 | Kida et al. | |
| 2002/0149553 | A1* | 10/2002 | Tsujimura et al. | 345/92 |
| 2007/0296682 | A1 | 12/2007 | Hwang | |
| 2008/0136809 | A1 | 6/2008 | Lee et al. | |

(Continued)

FOREIGN PATENT DOCUMENTS

| | | | |
|---|---|---|---|
| KR | 10-2006-0134779 | A | 12/2006 |
| KR | 10-2008-0010946 | A | 1/2008 |
| KR | 10-2008-0017626 | A | 2/2008 |

(Continued)

*Primary Examiner* — Thuy Pardo
(74) *Attorney, Agent, or Firm* — Innovation Counsel LLP

(57) ABSTRACT

A display device includes a display panel including gate lines, data lines, and pixels each connected to a corresponding gate line and a corresponding data line, a gate driver configured to drive the gate lines, a data driver configured to drive the data lines, and a timing controller configured to generate control signals to control the data driver and to apply a vertical synchronization start signal including a first pulse, a second pulse, a first gate pulse signal, and a second gate pulse signal to the gate driver. The gate driver applies gate driving signals to the gate lines to pre-charge the pixels in response to the first pulse of the vertical synchronization start signal and the first gate pulse signal, and to main-charge the pixels in response to the second pulse of the vertical synchronization start signal and the second gate pulse signal.

20 Claims, 11 Drawing Sheets

(56) References Cited

U.S. PATENT DOCUMENTS

| | | | | |
|---|---|---|---|---|
| 2008/0191987 | A1* | 8/2008 | Lee et al. | 345/92 |
| 2008/0224980 | A1 | 9/2008 | Senda et al. | |
| 2008/0284771 | A1* | 11/2008 | Matsuki | 345/211 |
| 2010/0315403 | A1* | 12/2010 | Kaneyoshi et al. | 345/211 |
| 2011/0074712 | A1* | 3/2011 | Bak et al. | 345/173 |
| 2011/0175859 | A1* | 7/2011 | Jang et al. | 345/204 |
| 2012/0105735 | A1* | 5/2012 | Tsubata | 348/731 |
| 2013/0215160 | A1* | 8/2013 | Pyun et al. | 345/691 |

FOREIGN PATENT DOCUMENTS

| | | | |
|---|---|---|---|
| KR | 10-2008-0025502 | A | 3/2008 |
| KR | 10-2008-0069441 | A | 7/2008 |
| KR | 10-2010-0048420 | A | 5/2010 |

* cited by examiner

DISPLAY DEVICE

CROSS-REFERENCE TO RELATED APPLICATION

This application claims priority under 35 U.S.C. §119 to Korean Patent Application No. 10-2012-0121537, filed on Oct. 30, 2012, the disclosure of which is incorporated by reference herein in its entirety.

BACKGROUND

1. Field of Disclosure

The present disclosure relates generally to display devices. More specifically, the present disclosure relates to.

2. Description of the Related Art

A display device typically includes a display panel set up to display an image, and data and gate drivers to drive the display panel. The display panel includes a plurality of gate lines, a plurality of data lines, and a plurality of pixels. Each pixel commonly includes a thin film transistor, a liquid crystal capacitor, and a storage capacitor. The data driver applies gray scale voltages to the data lines, and the gate driver outputs gate signals to drive the gate lines.

The display device applies a gate on voltage to a gate electrode of the thin film transistor, and applies a data voltage to a source electrode of the thin film transistor. The data voltage corresponds to a portion of the display image, so that a desired image is generated on the display.

In general, one data line is connected to plural pixels, and the pixels sequentially display the image. However, since the data voltage corresponding to the display image is successively applied to the one data line, the brightness of the image displayed in the pixels varies depending on a relation between the previous data voltage and the present data voltage. Due to the non-uniform brightness in the pixels, a display quality of the display device is degraded.

SUMMARY

An exemplary embodiment of the present invention provides a display device having improved display quality.

An exemplary embodiment of the invention provides a display device comprising a display panel that includes a plurality of gate lines, a plurality of data lines, and a plurality of pixels each connected to a corresponding gate line of the gate lines and a corresponding data line of the data lines, a gate driver configured to drive the gate lines, a data driver configured to drive the data lines, and a timing controller configured to generate a plurality of control signals to control the data driver and to apply a vertical synchronization start signal including a first pulse, a second pulse, a first gate pulse signal, and a second gate pulse signal to the gate driver. The gate driver is configured to apply gate driving signals to the gate lines to pre-charge the pixels in response to the first pulse of the vertical synchronization start signal and the first gate pulse signal and to main-charge the pixels in response to the second pulse of the vertical synchronization start signal and the second gate pulse signal.

In an exemplary embodiment of the present invention a pre-charge period of each of the gate driving signals corresponds to a pulse width of the first gate pulse signal, and a main charge period of each of the driving signals corresponds to a pulse width of the second gate pulse signal.

In an exemplary embodiment of the present invention the pulse width of the second gate pulse signal is set to allow the pre-charge period of a subsequent one of the gate driving signals to overlap with the main charge period of a previous one of the gate driving signals.

In an exemplary embodiment of the present invention the timing controller is configured to generate the first and second gate pulse signals such that an (i+2)th one of the gate lines is pre-charged during the main charge period of an i-th one of the gate lines, where i is a natural number.

In an exemplary embodiment of the present invention the gate driver includes a first signal generator configured to generate a first vertical synchronization start signal in response to the first pulse of the vertical synchronization start signal and the first gate pulse signal, a first shift register configured to generate pre-charge signals in response to the first vertical synchronization start signal and the first gate pulse signal, a second signal generator configured to generate a second vertical synchronization start signal in response to the second pulse of the vertical synchronization start signal and the second gate pulse signal, a second shift register configured to generate main charge signals in response to the second vertical synchronization start signal and the second gate pulse signal, and an output circuit configured to generate the gate driving signals from the pre-charge signals and the main charge signals.

In an exemplary embodiment of the present invention the first signal generator includes a first counter to count in response to the first gate pulse signal, and is configured to activate the first vertical synchronization start signal when the counted value of the first counter is greater than a reference value.

In an exemplary embodiment of the present invention the first counter is reset in response to the first vertical synchronization start signal.

In an exemplary embodiment of the present invention the second signal generator includes a second counter to count in response to the second gate pulse signal, and is configured to activate the second vertical synchronization start signal when the counted value of the second counter is smaller than a reference value.

In an exemplary embodiment of the present invention the second counter is reset in response to the second vertical synchronization start signal.

In an exemplary embodiment of the present invention the output circuit includes a gate signal generator configured to generate gate signals from the pre-charge signals and the main charge signals, a level shifter configured to boost a voltage level of the gate signals, and an output buffer configured to output the signals output from the level shifter as the gate driving signals.

In an exemplary embodiment of the present invention the gate signal generator includes a plurality of logic circuits each of which is configured to receive a corresponding pre-charge signal of the pre-charge signals and a corresponding main charge signal of the main charge signals, and to output a corresponding gate signal of the gate signals.

In an exemplary embodiment of the present invention the pre-charge signals are square wave signals and the main charge signals are not square wave signals.

In an exemplary embodiment of the present invention the vertical synchronization start signal includes a first vertical synchronization signal and a second vertical synchronization signal, and the gate driver is configured to apply gate driving signals to the gate lines so as to pre-charge the pixels in response to the first pulse of the first vertical synchronization start signal and the first gate pulse signal, and to main-charge the pixels in response to the second pulse of the second vertical synchronization start signal and the second gate pulse signal.

Among the pixels, the pixels arranged in a same column are connected in alternating manner to a data line on one side of the column and a data line on another side of the column.

While their respective pixels are driven, two data lines adjacent to each other are applied with data voltages having different polarities from each other with respect to a reference voltage.

An exemplary embodiments of the present invention provides a method of driving a display device includes generating pre-charge signals in response to a first pulse of a vertical synchronization start signal and a first gate pulse signal, so as to pre-charge a plurality of pixels, generating main charge signals in response to a second pulse of the vertical synchronization start signal and a second gate pulse signal, so as to main-charge the pixels, and generating gate driving signals to be applied to gate lines, the gate driving signals generated from the pre-charge signals and the main charge signals.

According to the above, since the pixels are firstly pre-charged by the data signals, secondly precharged by the data signal of the previous pixels, and then main-charged, the electric charge rate of the pixels may be increased even though the size of the display panel is increased. In addition, the gate driving signals do not include a kickback-reducing profile during the pre-charge period, so that the electric charge rate of the pixels may be prevented from being lowered during the pre-charged period. Thus, the image display quality of the display device may be improved.

BRIEF DESCRIPTION OF THE DRAWINGS

The above and other features of the present disclosure will become more apparent by describing in detail exemplary embodiments thereof describing in detail exemplary embodiments thereof with reference to the accompanying drawings, in which.

The Figures are not necessarily to scale.

DETAILED DESCRIPTION OF EXEMPLARY EMBODIMENTS

Exemplary embodiments of the present invention will be described more fully hereinafter with reference to the accompanying drawings. The present invention may, however, be embodied in different forms and should not be construed as limited to the embodiments set forth herein.

Hereinafter, the present invention will be explained in detail with reference to the accompanying drawings.

Figure 1:
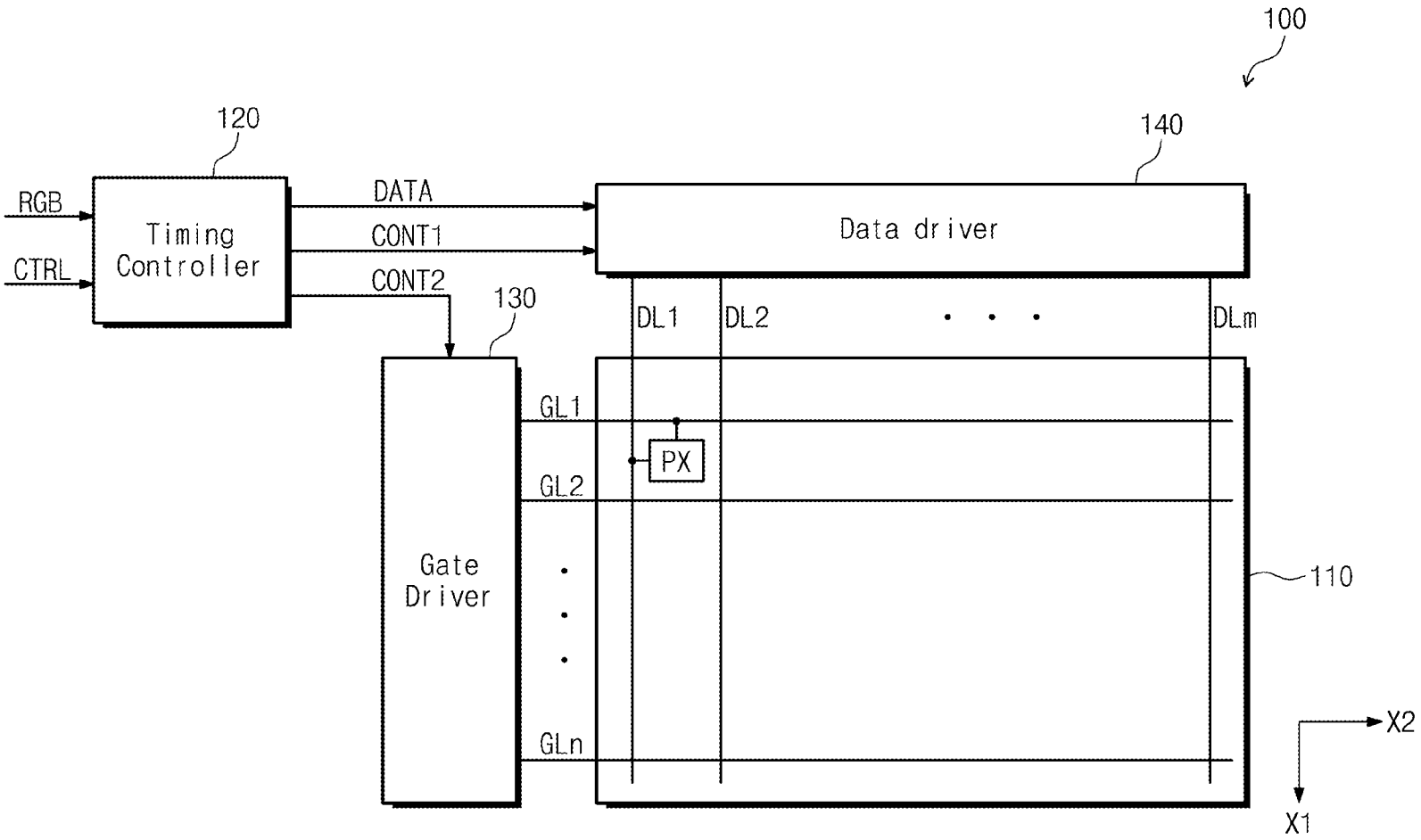
FIG. 1 is a block diagram showing a display device according to an exemplary embodiment of the present disclosure.

FIG. 1 is a block diagram showing a display device according to an exemplary embodiment of the present disclosure.

Referring to FIG. 1, the display device 100 includes a display panel 110, a timing controller 120, a gate driver 130, and a data driver 140.

The display panel 110 includes a plurality of data lines DL1 to DLm extended in a first direction X1, a plurality of gate lines GL1 to GLn extended in a second direction X2 to cross the data lines DL1 to DLm, and a plurality of pixels PX arranged in areas created by the matrix formed by the crossing of the data lines DL1 to DLm and the gate lines GL1 to GLn. The data lines DL1 to DLm are insulated from the gate lines GL1 to GLn.

Although not shown in FIG. 1, each pixel PX includes a switching transistor connected to a corresponding data line of the data lines DL1 to DLm and a corresponding gate line of the gate lines GL1 to GLn, a liquid crystal capacitor connected to the switching transistor, and a storage capacitor connected to the transistor.

The timing controller 120 receives image signals RGB and control signals CTRL. The control signals CTRL can include, but are not necessarily limited to, e.g., a vertical synchronization signal Vsync, a horizontal synchronization signal Hsync, a main clock signal MCLK, a data enable signal DE, etc., to control the image signals RGB. The timing controller 120 converts the image signal RGB to a data signal DATA appropriate to an operation condition of the display panel 110, on the basis of the control signals CTRL.

The timing controller 120 applies the data signal DATA and a first driving control signal CONT1 to the data driver 140, and applies a second driving control signal CONT2 to the gate driver 130. The first driving control signal CONT1 includes a horizontal synchronization start signal STH, a clock signal HCLK, and a line latch signal TP, and the second driving control signal CONT2 includes a vertical synchronization start signal STV, a first gate pulse signal CPV1, and a second gate pulse signal CPV2. According to certain other embodiments, the second driving control signal CONT2 includes a first vertical synchronization start signal STV1, a second vertical synchronization start signal STV2, a first gate pulse signal CPV1, and a second gate pulse signal CPV2.

The data driver 140 outputs data output signals to drive the data lines DL1 to DLm in response to the data signal DATA and the first driving control signal CONT1.

The gate driver 130 drives the gate lines GL1 to GLn in response to the second driving control signal CONT2 from the timing controller 120. The gate driver 130 includes a gate driver IC, but the gate driver 130 should not be limited to a gate driver IC. That is, the gate driver 130 may be configured to include a circuit made of oxide semiconductor, amorphous semiconductor, crystalline semiconductor, or polycrystalline semiconductor.

Figure 2:
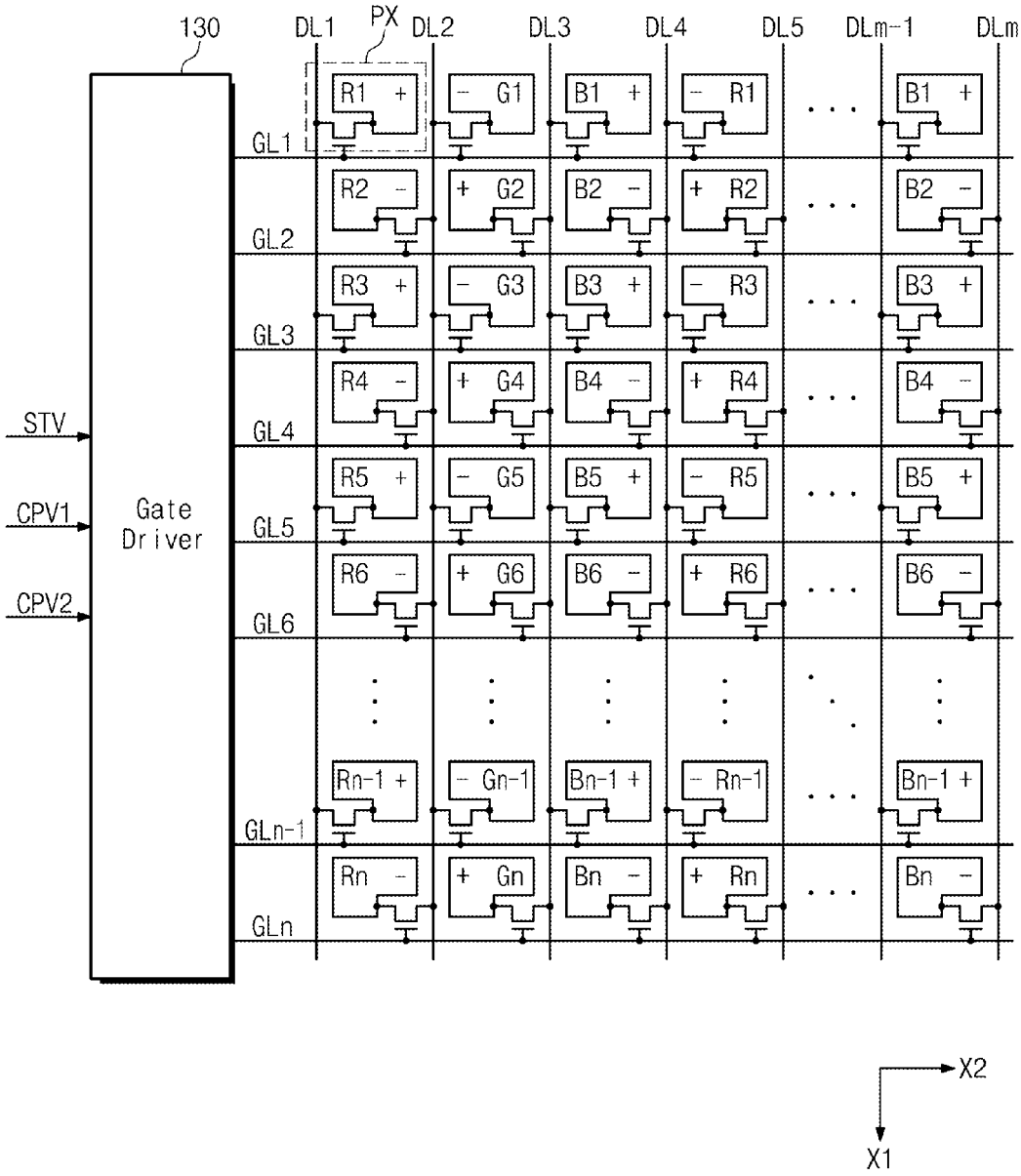
FIG. 2 is a view showing a configuration of a gate driver and an arrangement of pixels in a display panel shown in FIG. 1.

FIG. 2 is a view showing a configuration of a gate driver and an arrangement of pixels in a display panel shown in FIG. 1.

Referring to FIG. 2, one pixel PX of the display panel 110 includes one pixel electrode corresponding to a red, green, or blue color, and a switching transistor. Hereinafter, a pixel including a pixel electrode corresponding to the red color, a pixel including a pixel electrode corresponding to the green color, and a pixel including a pixel electrode corresponding to the blue color will be referred to as a red pixel R, a green pixel G, and a blue pixel B, respectively.

Each switching transistor is connected to one of the corresponding data lines DL1 to DLm and one of the corresponding gate lines GL1 to GLn. The pixels PX are arranged in the first and second directions X1 and X2. In detail, pixels PX having the same color are arranged in the first direction X1 in which the data lines DL1 to DLm are extended, and pixels PX having different colors are arranged in the second direction X2 in which the gate lines GL1 to GLn are extended. For instance, red pixels R1 to Rn are disposed at a right side of the data line DL1 and sequentially arranged in the first direction X1, green pixels G1 to Gn are disposed between the data lines DL2 and DL3 and sequentially arranged in the first direction X1, and blue pixels B1 to Bn are disposed between the data lines DL3 and DL4 and sequentially arranged in the first direction X1. In the present exemplary embodiment, red, green, and blue pixels R, G, and B are sequentially arranged in the second direction X2, but the arrangement order of the red, green, and blue pixels R, G, and B should not be limited thereto or thereby. That is, the red, green, and blue pixels R, G, and B may be arranged in the order of red, blue, and green pixels R, B, and G; green, blue, and red pixels G, B, and R; green, red, and blue pixels G, R, and B; blue, red, and green pixels B, R, and G; or blue, green, and red pixels B, G, and R.

Referring to FIG. 2, a first group of the red, green, and blue pixels R1 to Rn, G1 to Gn, and B1 to Bn is connected to their left-side data lines, and a second group of the red, green, and blue pixels R1 to Rn, G1 to Gn, and B1 to Bn is connected to their right-side data lines. In detail, the switching transistor of each of the pixels connected to odd-numbered gate lines GL1, GL3, GL5, . . . , GLn-1 is connected to its left-side data line, and the switching transistor of each of the pixels connected to even-numbered gate lines GL2, GL4, GL6, . . . , GLn is connected to its right-side data line. That is, the red, green, and blue pixels R1 to Rn, G1 to Gn, and B1 to Bn are alternately connected to the left-side data line and the right-side data line in a zigzag connection, i.e. pixels in each column are connected to their left-side data line and right-side data line in alternating manner.

For instance, the switching transistors connected to the gate line GL1 are connected to their left-side data line, and the switching transistors connected to the gate line GL2 are connected to their right-side data line.

The data lines DL1 to DLm are driven in a column inversion manner in which polarities of the voltages applied to the data lines are alternated per column.

According to the connection between the red, green, and blue pixels R1 to Rn, G1 to Gn, and B1 to Bn and the data lines DL1 to DLm, an inversion appearing on a screen, i.e., an apparent inversion, is the same dot inversion even though the data lines DL1 to DLm are driven in the column inversion manner by the data driver 140. That is, the polarities applied to the pixels are the same as in a dot inversion scheme, even though voltages are applied to the data lines in a column inversion scheme. Thus, gray scale voltages applied to adjacent pixels have complementary polarities from each other. When the apparent inversion is dot inversion, a vertical flicker may be prevented since a brightness difference caused by a kickback voltage is reduced.

Figure 3:
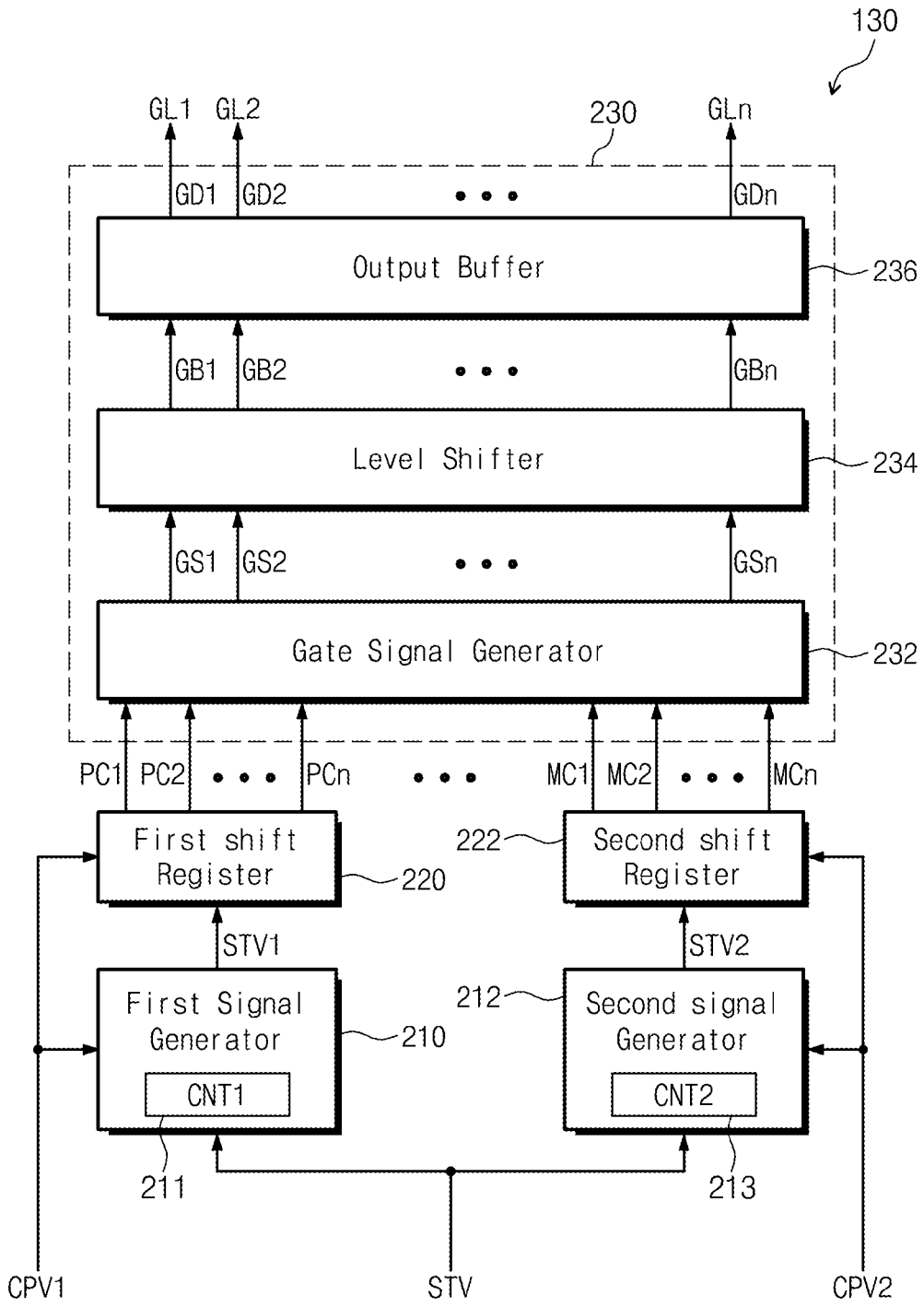
FIG. 3 is a block diagram showing the gate driver shown in FIG. 2 according to an exemplary embodiment of the present disclosure.

FIG. 3 is a block diagram showing the gate driver shown in FIG. 2 according to an exemplary embodiment of the present disclosure.

Referring to FIG. 3, the gate driver 130 includes a first signal generator 210, a second signal generator 212, a first shift register 220, a second shift register 222, and an output circuit 230.

In the present exemplary embodiment, the second driving control signal CONT2 applied to the gate driver 130 from the timing controller 120 shown in FIG. 1 includes the vertical synchronization start signal STV, the first gate pulse signal CPV1, and the second gate pulse signal CPV2.

The first signal generator 210 generates a first vertical synchronization start signal STV1 in response to the vertical synchronization start signal STV and the first gate pulse signal CPV1. The second signal generator 220 generates a second vertical synchronization start signal STV2 in response to the vertical synchronization start signal STV and the second gate pulse signal CPV2.

The first shift register 220 generates pre-charge signals PC1 to PCn in response to the first vertical synchronization start signal STV1 and the first gate pulse signal CPV1. The second shift register 222 generates main charge signals MC1 to MCn in response to the second vertical synchronization start signal STV2 and the second gate pulse signal CPV2.

The output circuit 230 includes a gate signal generator 232, a level shifter 234, and an output buffer 236. The gate signal generator 232 synthesizes the pre-charge signals PC1 to PCn from the first shift register 220 and the main charge signals MC1 to MCn from the second shift register 222 to generate gate signals GS1 to GSn. The level shifter 234 boosts a voltage level of the gate signals GS1 to GSn to output boosting gate signals GB1 to GBn. The output buffer 236 outputs the boosting gate signals GB1 to GBn as gate driving signals GD1 to GDn. The gate driving signals GD1 to GDn are applied to the gate lines GL1 to GLn.

Figure 4:
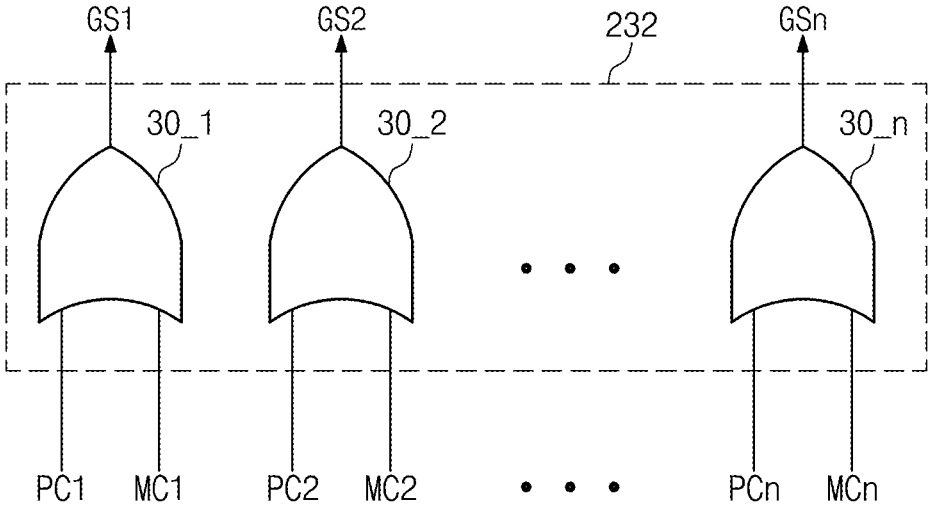
FIG. 4 is a view showing a gate signal generator shown in FIG. 3.

FIG. 4 is a view showing the gate signal generator shown in FIG. 3.

Referring to FIG. 4, the gate signal generator 232 includes a plurality of logic circuits 30-1 to **30-*n*** each configured to include an OR gate circuit.

Each of the logic circuits 30-1 to **30-*n* outputs its gate signal in response to a corresponding pre-charge signal of the pre-charge signals PC1 to PCn from the first shift register 220 and a corresponding main charge signal of the main charge signals MC1 to MCn from the second shift register 222. For instance, the logic circuit 30-1 outputs the gate signal G1 in response to the pre-charge signal PC1 and the main charge signal MC1, the logic circuit 30-2 outputs the gate signal G2 in response to the pre-charge signal PC2 and the main charge signal MC2, and the logic circuit 30-*n*** outputs the gate signal Gn in response to the pre-charge signal PCn and the main charge signal MCn.

Figure 5:
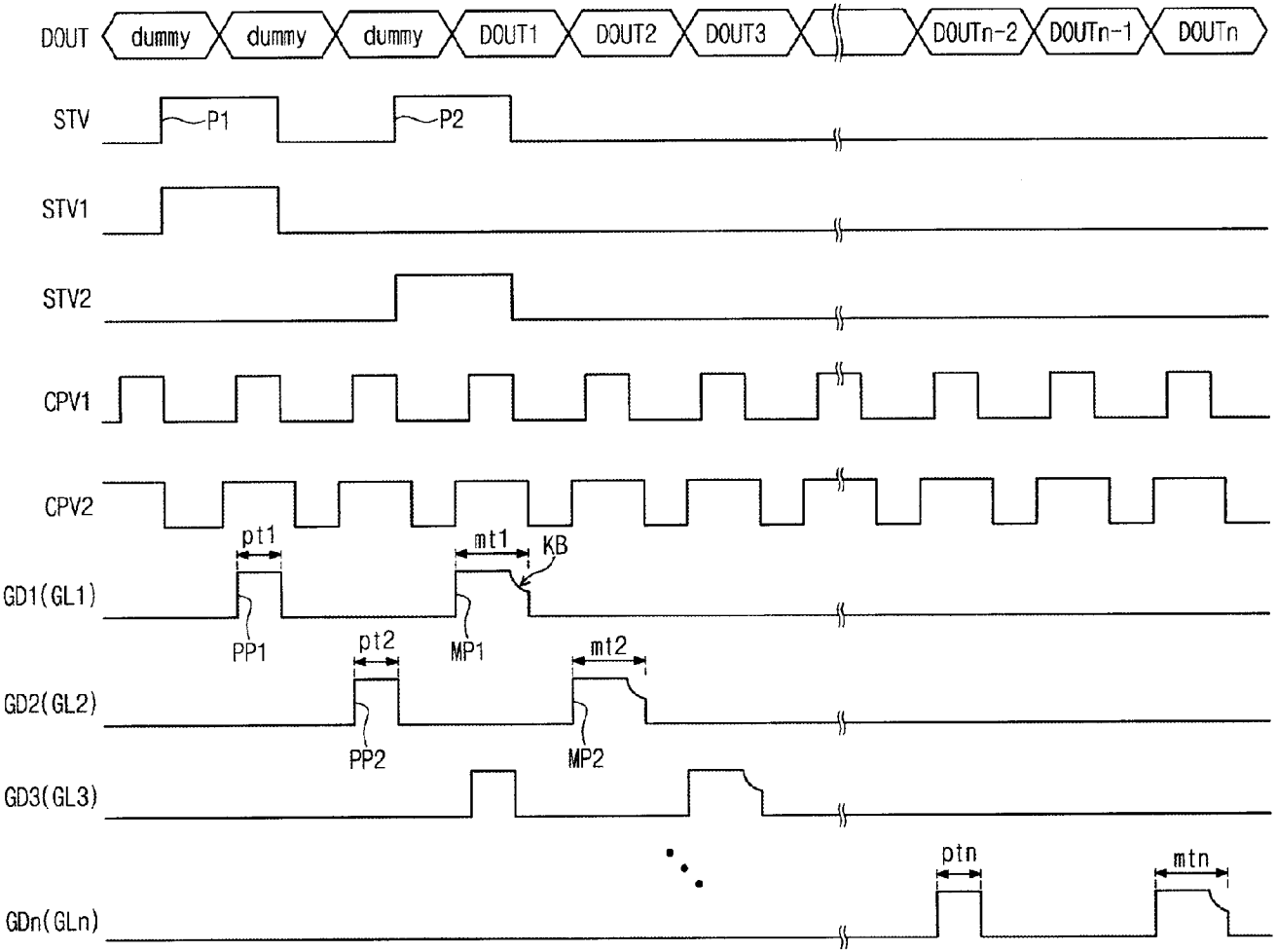
FIG. 5 is a timing diagram showing an operation of the gate driver shown in FIG. 3.

FIG. 5 is a timing diagram showing an operation of the gate driver shown in FIG. 3.

Referring to FIGS. 3 and 5, the vertical synchronization start signal STV from the timing controller 120 shown in FIG. 1 includes a first pulse P1 and a second pulse P2. The first signal generator 210 generates the first vertical synchronization start signal STV1 in response to the first pulse P1 of the vertical synchronization start signal STV. The second signal generator 212 generates the second vertical synchronization start signal STV2 in response to the second pulse P2 of the vertical synchronization start signal STV.

The first shift register 220 sequentially activates the pre-charge signals PC1 to PCn in response to the first vertical synchronization start signal STV1 and the first gate pulse signal CPV1. For instance, after the first vertical synchronization start signal STV1 is activated to the high level, the first shifter register 220 activates the pre-charge signal PC1 at a first rising edge of the first gate pulse signal CPV1 to a high level, and activates the pre-charge signal PC2 at a second rising edge of the first gate pulse signal CPV1 to the high level. As described above, the pre-charge signals PC1 to PCn are sequentially activated.

The second shift register 222 sequentially activates the main charge signals MC1 to MCn in response to the second vertical synchronization start signal STV2 and the second gate pulse signal CPV2. For instance, after the second vertical synchronization start signal STV2 is activated to the high level, the second shifter register 222 activates the main charge signal MC1 at a first rising edge of the second gate pulse signal CPV2 to a high level and activates the main charge signal MC2 at a second rising edge of the second gate pulse signal CPV2 to the high level. As described above, the main charge signals MC1 to MCn are sequentially activated.

The output circuit 230 synthesizes the pre-charges PC1 to PCn and the main charge signals MC1 to MCn, and outputs the gate driving signals GD1 to GDn.

Each of the gate driving signals GD1 to GDn applied to the gate lines GL1 to GLn includes a pre-charge pulse and a main charge pulse. For instance, the gate driving signal GD1 includes the pre-charge pulse PP 1 and the main charge pulse MP1, and the gate driving signal GD2 includes the pre-charge pulse PP2 and the main charge pulse MP2.

A pulse width, e.g., pt1 to ptn, of each of the pre-charge pulses PP1 to PPn corresponds to a pulse width of the first gate pulse signal CPV1 and a pulse width, e.g., mt1 to mtn, of each of the main charge pulses MP1 to MPn corresponds to a pulse width of the second gate pulse signal CPV2.

Referring to FIGS. 2 and 5, the pixels R3, G3, and B3 connected to the gate line GL3 are pre-charged during a main charge period of the pixels R1, G1, and B1 connected to the gate line GL 1. In addition, the pixels R4, G4, and B4 connected to the gate line GL4 are pre-charged during a main charge period of the pixels R2, G2, and B2 connected to the gate line GL2. As described above, the pixels connected to an (i+2)th gate line GLi+2 are pre-charged during a main charge period of the pixels connected to an i-th gate line GLi. In this case, i is a natural number equal to or smaller than n, and n is a number of the gate lines GL1 to GLn.

For instance, among the pixels connected to the data line DL2, the green pixel G3 connected to the gate line GL3 is pre-charged during the main charge period of the green pixel G1 connected to the gate line GL1. The data line DL2 is connected to the red pixels R2, R4, . . . , R6, Rn and the green pixels G1, G3, G5, Gn−1. As an example, when the red pixels R2, R4, R6, . . . , Rn connected to the data line DL2 are turned off and the green pixels G1, G3, G5, . . . , Gn−1 connected to the data line DL2 are turned on, a level of gray scale voltage of the data output signal provided through the data line DL2 is at a minimum level in the main charge period of the red pixel R2 connected to the gate line GL2. Therefore, a level of gray scale voltage pre-charged in the green pixel G3 during the main charge period of the red pixel R2 is at the minimum level—the pre-charge period of gate driving signal GD3 occurs before MP2, not during it. In a case that the green pixel G3 is main-charged without being sufficiently pre-charged, an amount of electric charge in the green pixel G3 is insufficient. Consequently, the brightness of the green pixels G3, G5, G7, . . . , Gn−1 connected to the data line DL2 is decreased. In this case, when the blue pixels B1, B3, B5, . . . , Bn−1 connected to the data line DL3 are turned on, the brightness of the green pixels G2, G4, G6, . . . , Gn connected to the data line DL3 is increased, as they are also connected to DL3 and thus receive charge. In this manner, the brightness of the green pixels G1 to Gncan be repeatedly increased and decreased at every pixel during image display, generating a variation in brightness that is perceived by a user.

The display device 100 according to the present exemplary embodiment allows the pixels connected to the (i+2)th gate line GLi+2 to be pre-charged while the pixels connected to the i-th gate line GLi are main-charged, and thus an electric charge rate of the pixels may be increased.

As shown in FIG. 5, the first gate pulse signal CPV1 has a pulse width narrower than the pulse width of the second gate pulse signal CPV2. Therefore, the pre-charge periods pt1 to ptn of the gate driving signals GD1 to GDn are shorter than the main charge period mt1 to mtn of the gate driving signals GD1 to GDn.

As described with reference to FIG. 1, the display device 100 applies the gate driving signal GDi having the level of the gate on voltage to the gate electrode of the switching transistor connected to the gate line GLi, and applies the data voltage corresponding to the display image to the source electrode of the switching transistor connected to the gate line GLi, thereby displaying the desired image. The data voltage charged in the liquid crystal capacitor and the storage capacitor when the switching transistor is turned on should be maintained during a predetermined time period after the switching transistor is turned off. Due to a parasitic capacitance occurring between the gate electrode and the drain electrode, however, the data voltage applied to the liquid crystal capacitor and the storage capacitor is distorted. This is called a kickback voltage. To reduce the kickback voltage, a method of decreasing the level of the gate on voltage is widely used. However, when the level of the gate on voltage is decreased, a driving ability of the switching transistor is degraded.

As another method of reducing the kickback voltage, the gate driving signals GD1 to GDn may be controlled to be lowered with a predetermined slope, i.e., to include a kickback KB, when the gate driving signals GD1 to GDn are transited to the level of the gate off voltage from the level of the gate on voltage. That is, instead of a square wave profile, some or all of the gate driving signals are given a profile which either increases gradually to, or decreases gradually from, the maximum value. In this method, the voltage level at a falling edge of the gate driving signals GD1 to GDn, is lowered gradually.

In FIG. 5, the pre-charge pulses PP 1 to PPn do not have a kickback-reducing profile (i.e. are square waves) and only the main charge pulses MP1 to MPn have such a profile (i.e. are not square waves/have a non-square wave profile). Nevertheless, deterioration in image quality, which is caused by the kickback voltage, may be prevented. In addition, since the pre-charge pulses PP1 to PPn do not have a kickback-reducing profile, the amount of the electric charges on the pixels may be prevented from being reduced during the pre-charge period.

Figure 6:
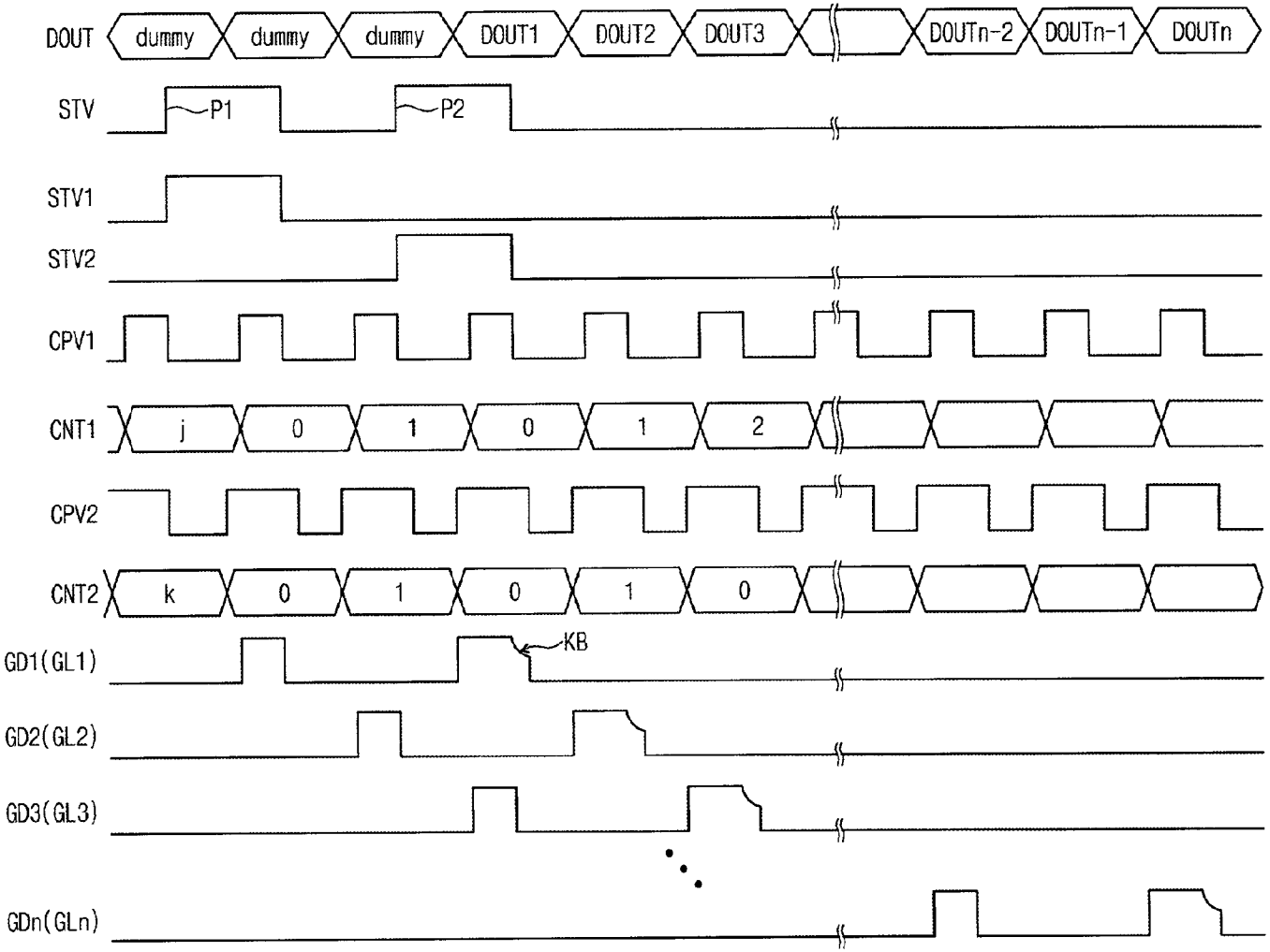
FIG. 6 is a timing diagram showing a first signal generator and a second signal generator shown in FIG. 3, which generate a first vertical synchronization start signal and a second vertical synchronization start signal, respectively.

FIG. 6 is a timing diagram showing signals of the first signal generator and the second signal generator shown in FIG. 3, which generate the first vertical synchronization start signal STV1 and the second vertical synchronization start signal STV2, respectively.

Referring to FIGS. 3 and 6, the first signal generator 210 includes a first counter 211 and the second signal generator 213 includes a second counter 213. The first counter 211 of the first signal generator 210 starts to count in synchronization with the first gate pulse signal CPV1. The first signal generator 210 activates the first vertical synchronization start signal STV1 to the high level when a counted value k of the first counter 211 becomes greater than a reference value. For instance, the first signal generator 210 outputs the first pulse P1 of the vertical synchronization signal STV as the first vertical synchronization start signal STV1 when the counted value k of the first counter 211 becomes greater than the reference value. As an example, the reference value can be 2.

The second counter 213 of the second signal generator 212 starts to count in synchronization with the second gate pulse signal CPV2. The second signal generator 212 activates the second vertical synchronization start signal STV2 to the high level when a counted value k of the second counter 213 is smaller than the reference value. For instance, the second signal generator 212 outputs the second pulse P2 of the vertical synchronization signal STV as the second vertical synchronization start signal STV2 when the counted value k of the second counter 213 is smaller than the reference value. As an example, the reference value can be 2.

The first and second counters 211 and 213 are reset to zero (0) at the falling edge of the vertical synchronization start signal STV.

Figure 7:
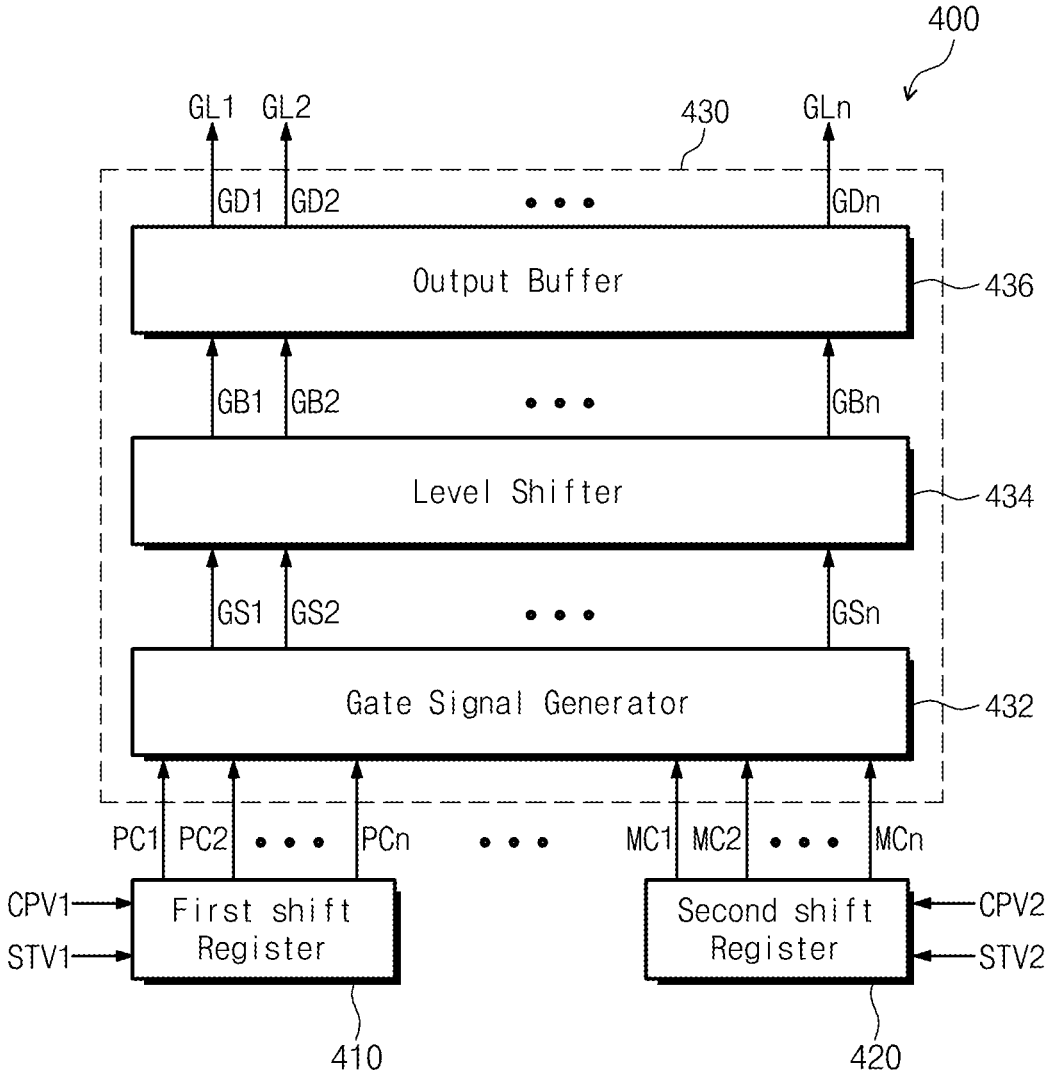
FIG. 7 is a block diagram showing a gate driver shown in FIG. 1 according to another exemplary embodiment of the present disclosure.

FIG. 7 is a block diagram showing a gate driver shown in FIG. 1 according to another exemplary embodiment of the present disclosure.

Referring to FIG. 7, the second driving control signal CONT2 applied to the gate driver 400 from the timing controller 120 shown in FIG. 1 includes the first vertical synchronization start signal STV1, the second vertical synchronization start signal STV2, the first gate pulse signal CPV1, and the second gate pulse signal CPV2.

Since the timing controller 120 provides the first gate pulse signal CPV1 and the second gate pulse signal CPV2, the gate driver 400 does not need to include the first and second signal generators 211 and 213 of FIG. 3.

The gate driver 400 includes a first shift register 410, a second shift register 420, and an output circuit 430. The output circuit 430 includes a gate signal generator 432, a level shifter 434, and an output buffer 436.

The first shift register 410 generates pre-charge signals PC1 to PCn in response to the first vertical synchronization start signal STV1 and the first gate pulse signal CPV1. The second shift register 420 generates main signals MC1 to MCn in response to the second vertical synchronization start signal STV2 and the second gate pulse signal CPV2. The output circuit 430 synthesizes the pre-charge signals PC1 to PCn from the first shift register 410 and the main charge signals MC1 to MCn from the second shift register 420, and generates gate driving signals GD1 to GDn to drive the gate lines GL1 to GLn. The configuration and operation of the output circuit 430 are the same as those of the output circuit 230 shown in FIG. 3.

Figure 8:
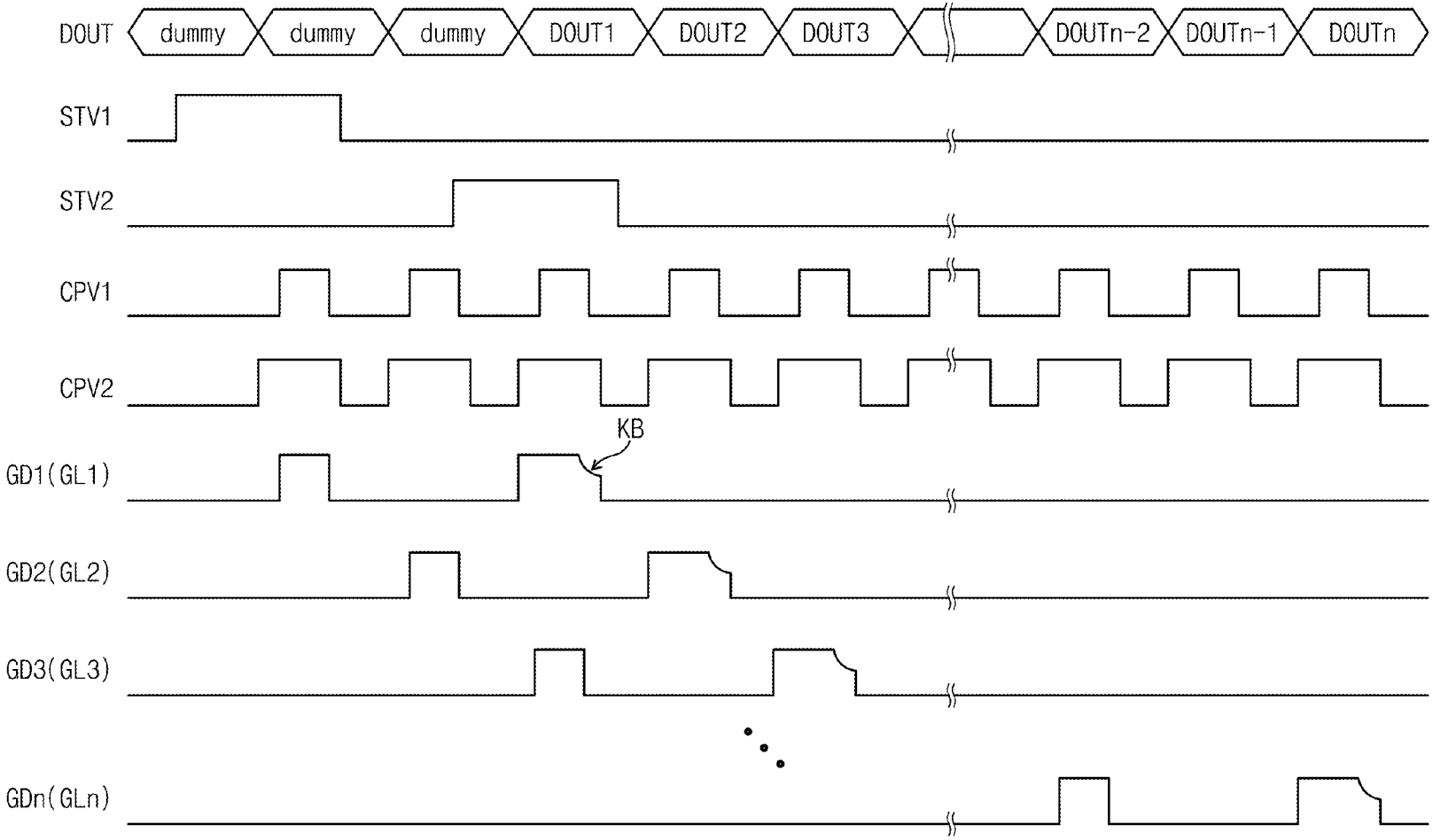
FIG. 8 is a timing diagram showing an operation of the gate driver shown in FIG. 7.

FIG. 8 is a timing diagram showing an operation of the gate driver shown in FIG. 7.

Referring to FIGS. 7 and 8, the gate driver 400 generates the gate driving signals GD1 to GDn in response to the first vertical synchronization start signal STV1 and the second vertical synchronization start signal STV2 from the timing controller 120 shown in FIG. 1.

As described with reference to FIG. 5, the gate driver 400 allows the pixels connected to the (i+2)th gate line GLi+2 to be pre-charged while the pixels connected to the i-th gate line GLi are main-charged, and thus an electric charge rate of the pixels may be increased.

Figure 9:
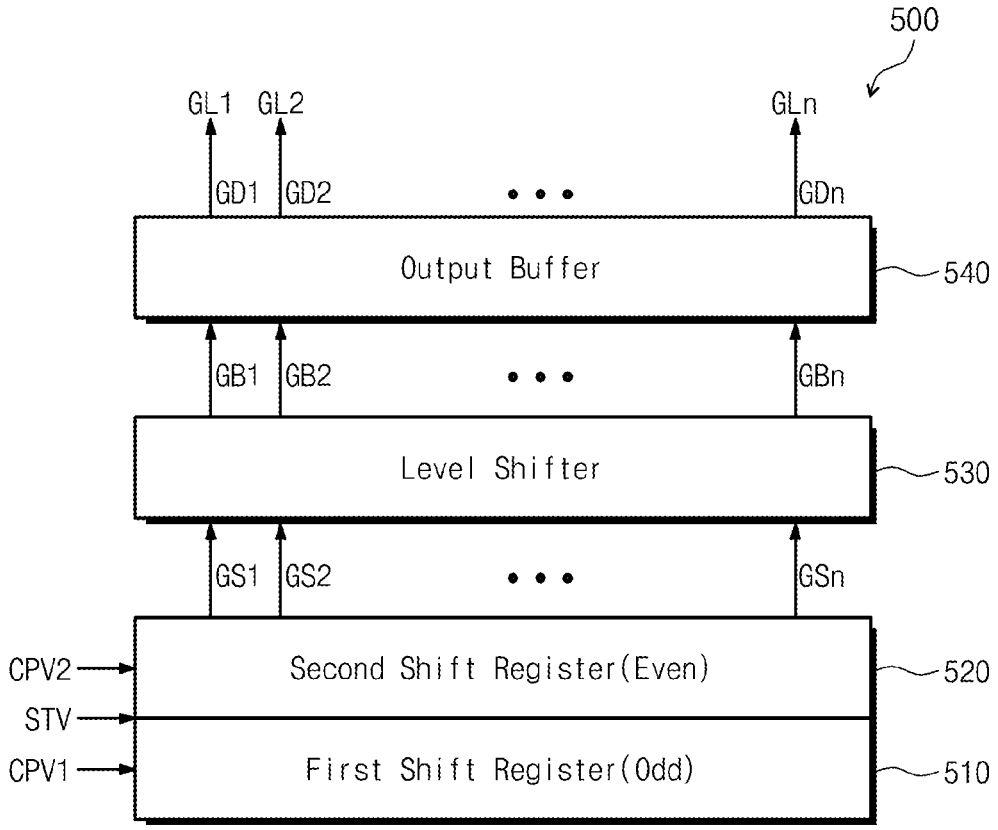
FIG. 9 is a block diagram showing a gate driver shown in FIG. 1 according to another exemplary embodiment of the present disclosure.

FIG. 9 is a block diagram showing a gate driver shown in FIG. 1 according to another exemplary embodiment of the present disclosure.

Referring to FIG. 9, the second driving control signal CONT2 applied to the gate driver 500 from the timing controller 120 shown in FIG. 1 includes the vertical synchronization start signal STV, the first gate pulse signal CPV1, and the second gate pulse signal CPV2.

The first and second shift register 510 and 520 generate the gate signals GS1 to GSn in response to the vertical synchronization start signal STV, the first gate pulse signal CPV1, and the second gate pulse signal CPV2. The first shift register 510 generates odd-numbered gate signals GS1, GS3, . . . , GSn−1 in response to the vertical synchronization start signal STV and the first gate pulse signal CPV1. The second shift register 520 generates even-numbered gate signals GS2, GS4, . . . , GSn in response to the vertical synchronization start signal STV and the second gate pulse signal CPV2.

The level shifter 530 boosts the voltage level of the gate signals GS1 to GSn to output the boosted gate signals GB 1 to GBn. The output buffer 540 outputs the boosted gate signals GB1 to GBn as the gate driving signals GD1 to GDn. The gate driving signals GD1 to GDn are applied to the gate lines GL1 to GLn, respectively.

Figure 10:
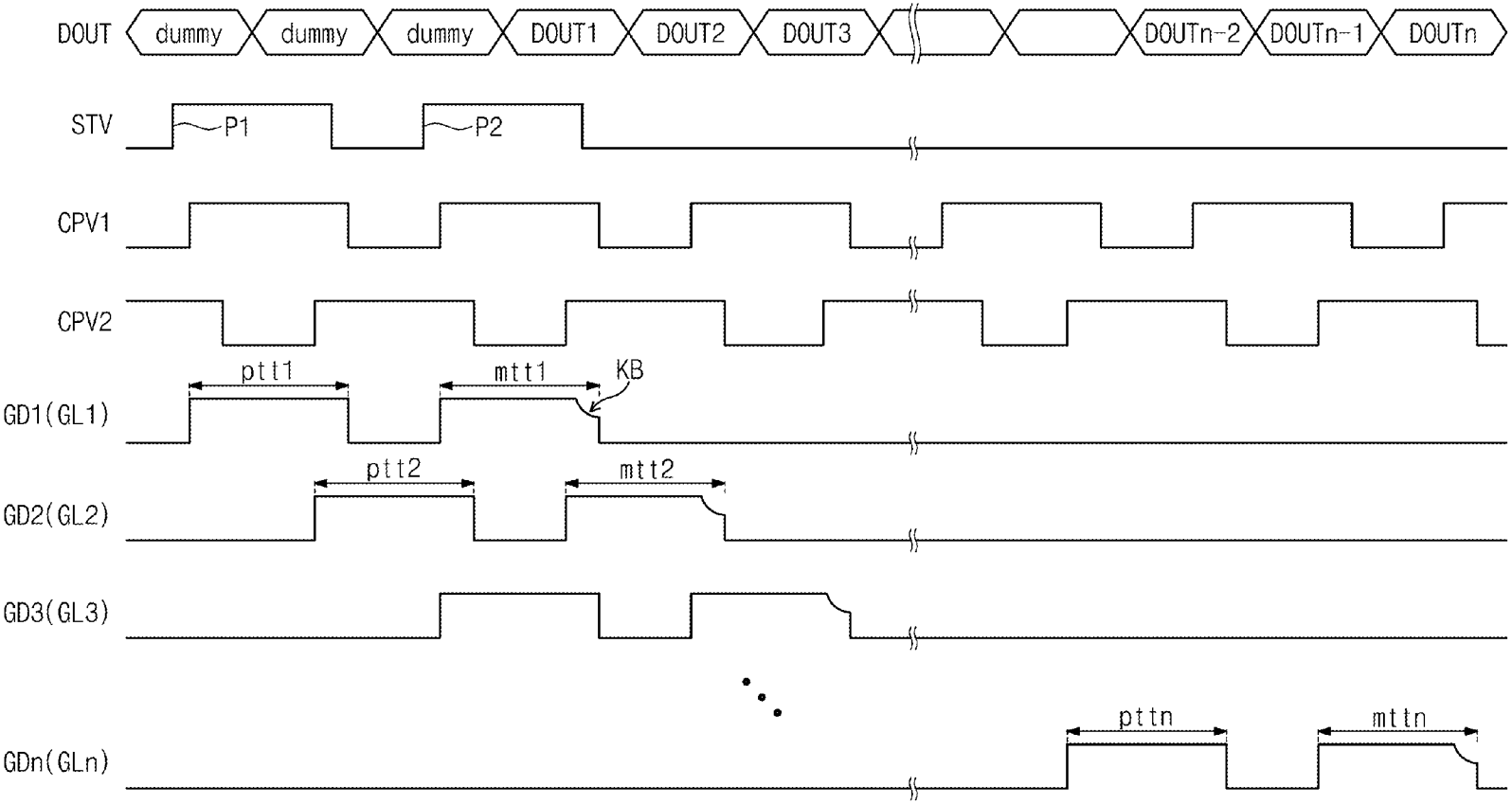
FIG. 10 is a timing diagram showing an operation of the gate driver shown in FIG. 9.

FIG. 10 is a timing diagram showing an operation of the gate driver shown in FIG. 9.

Referring to FIGS. 9 and 10, the vertical synchronization start signal STV from the timing controller 120 shown in FIG. 1 includes the first pulse P1 and the second pulse P2. The odd-numbered gate driving signals GD1, GD3, . . . , Gn−1 are generated in synchronization with the first gate pulse signal CPV1 while the vertical synchronization start signal STV is at a high level, and the even-numbered gate driving signals GD2, GD4, . . . , GDn are generated in synchronization with the second gate pulse signal CPV2 while the vertical synchronization start signal STV is at the high level.

A pre-charge pulse width ptt1 and a main charge pulse width mtt1 of the odd-numbered gate driving signals GD1, GD3, and Gn−1 correspond to the pulse width of the first gate pulse signal CPV1. A pre-charge pulse width ptt2 and a main charge pulse width mtt2 of the even-numbered gate driving signals GD2, GD4, and GDn correspond to the pulse width of the second gate pulse signal CPV2.

When the first and second gate pulse signals CPV1 and CPV2 have the same pulse width, the pre-charge pulse width ptt1 and the main charge pulse width mtt1 of the odd-numbered gate driving signals GD1, GD3, . . . , Gn−1 are the same as the pre-charge pulse width ptt2 and the main charge pulse width mtt2 of the even-numbered gate driving signals GD2, GD4, . . . , GDn.

Referring to FIGS. 2 and 10, the pixels R3, G3, and B3 connected to the gate line GL3 are pre-charged during the main charge period of the pixels R1, G1, and B1 connected to the gate line GL1. In addition, the pixels R4, G4, and B4 connected to the gate line GL4 are pre-charged during the main charge period of the pixels R2, G2, and B2 connected to the gate line GL2. As described above, the pixels connected to the (i+2)th gate line GLi+2 are pre-charged during the main charge period of the pixels connected to the i-th gate line GLi. In this case, i is a natural number equal to or smaller than n. Therefore, the electric charge rate of the pixels may be increased.

In addition, when the pre-charge period of a previous gate line GLi is partially overlapped with a pre-charge period of a next gate line GLi+1 and the main charge period of the previous gate line GLi is partially overlapped with the main charge period of the next gate line GLi+1, a ghost phenomenon may be prevented.

Figure 11:
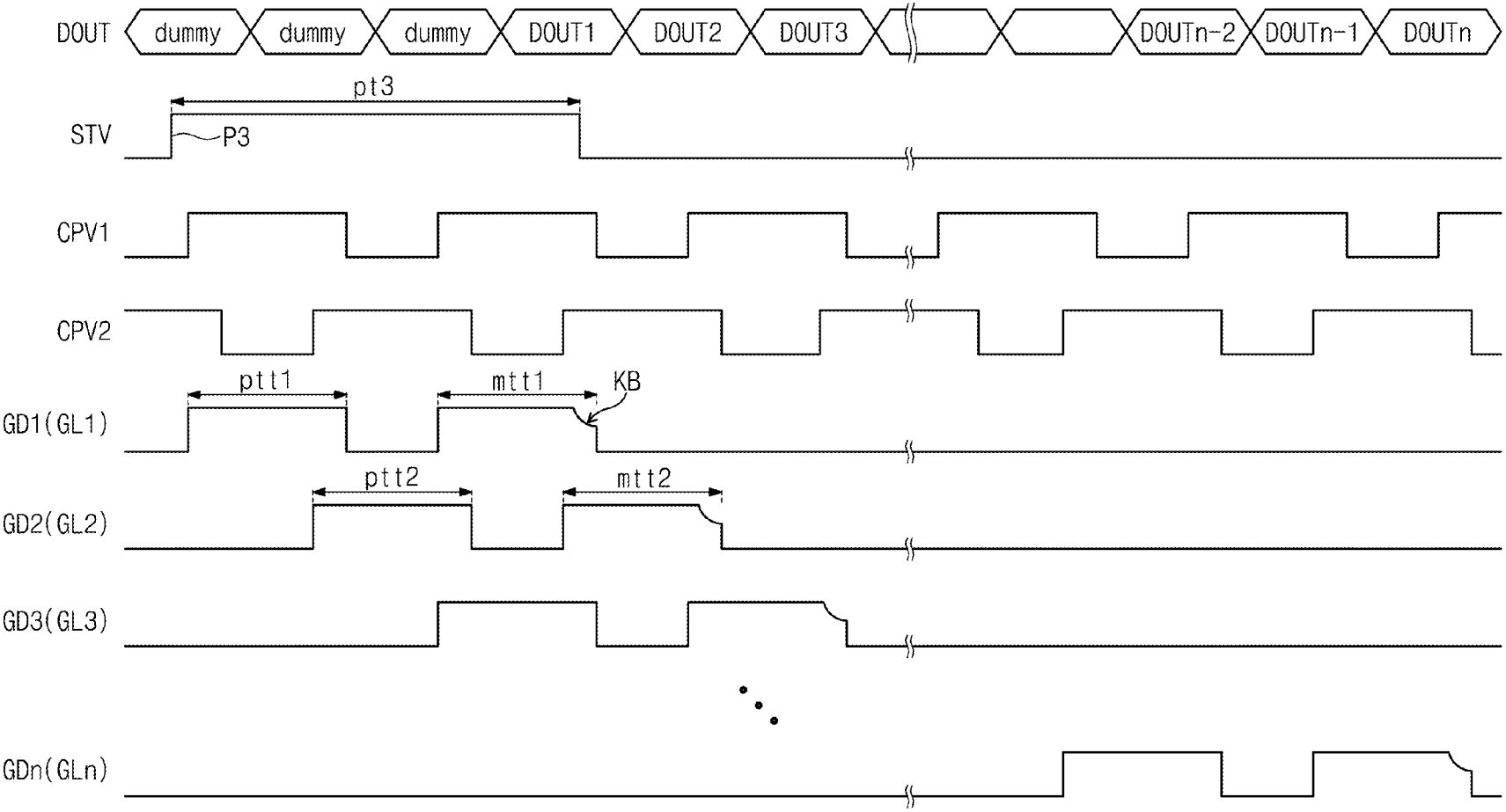
FIG. 11 is a block diagram showing a gate driver shown in FIG. 9 according to another exemplary embodiment of the present disclosure.

FIG. 11 is a block diagram showing a gate driver shown in FIG. 9 according to another exemplary embodiment of the present disclosure.

Referring to FIG. 11, the vertical synchronization start signal STV from the timing controller 120 shown in FIG. 1 includes a third pulse P3. The third pulse P3 has a pulse width pt3 corresponding to a time period in which the vertical synchronization start signal STV is transited to the high level, the first gate pulse signal CPV1 is transited two times to the high level, and the second gate pulse signal CPV2 is transited two times to the high level.

The first shift register 510 shown in FIG. 9 generates odd-numbered gate driving signals GD1 GD3, . . . , Gn−1 in synchronization with the first gate pulse signal CPV1 during the high level of the vertical synchronization start signal STV. The second shift register 520 shown in FIG. 9 generates even-numbered gate driving signals GD2 GD4, . . . , GDn in synchronization with the second gate pulse signal CPV2 during the high level of the vertical synchronization start signal STV.

In FIG. 11, the pixels connected to the (i+2)th gate line GLi+2 are pre-charged during the main charge period of the pixels connected to the i-th gate line GLi. In this case, i is a natural number equal to or smaller than n. Therefore, the electric charge rate of the pixels may be increased.

In FIG. 11, the gate driving signals GD1 to GDn do not include the kickback KB during the pre-charge period and do include the kickback KB during only the main charge period. Thus, the amount of the electric charges of the pixels may be prevented from being reduced during the pre-charge period.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display device comprising:

a display panel which includes a plurality of gate lines, a plurality of data lines, and a plurality of pixels each connected to a corresponding gate line of the gate lines and a corresponding data line of the data lines;

a gate driver configured to drive the gate lines;

a data driver configured to drive the data lines; and a timing controller configured to generate a plurality of control signals to control the data driver and to apply a vertical synchronization start signal including a first pulse, a second pulse, a first gate pulse signal, and a second gate pulse signal to the gate driver, wherein the gate driver is configured to apply gate driving signals to the gate lines so as to pre-charge the pixels in response to the first pulse of the vertical synchronization start signal and the first gate pulse signal, and to main-charge the pixels in response to the second pulse of the vertical synchronization start signal and the second gate pulse signal, wherein each of the gate driving signals comprises a pre-charge signal and a main charge signal, the main-charge signal beginning after the pre-charge signal ends, and wherein each of the pixels is configured to be pre-charged in response to the pre-charge signal, and to be main-charged in response to the main charge signal.

2. The display device of claim 1, wherein a pre-charge period of each of the gate driving signals corresponds to a pulse width of the first gate pulse signal, and a main charge period of each of the gate driving signals corresponds to a pulse width of the second gate pulse signal.

3. The display device of claim 2, wherein the pulse width of the second gate pulse signal is set to allow the pre-charge period of a subsequent one of the gate driving signals to overlap with the main charge period of a previous one of the gate driving signals.

4. The display device of claim 1, wherein the timing controller is configured to generate the first gate pulse signal and the second gate pulse signal such that an (i+2)th one of the gate lines is pre-charged during the main charge period of an i-th one of the gate lines, where i is a natural number.

5. The display device of claim 1, wherein the gate driver comprises:

a first signal generator configured to generate a first vertical synchronization start signal in response to the first pulse of the vertical synchronization start signal and the first gate pulse signal;

a first shift register configured to generate pre-charge signals in response to the first vertical synchronization start signal and the first gate pulse signal;

a second signal generator configured to generate a second vertical synchronization start signal in response to the second pulse of the vertical synchronization start signal and the second gate pulse signal;

a second shift register configured to generate main charge signals in response to the second vertical synchronization start signal and the second gate pulse signal; and an output circuit configured to generate the gate driving signals from the pre-charge signals and the main charge signals.

6. The display device of claim 5, wherein the first signal generator comprises a first counter to count in response to the first gate pulse signal, and is configured to activate the first vertical synchronization start signal when the counted value of the first counter is greater than a reference value.

7. The display device of claim 6, wherein the first counter is reset in response to the first vertical synchronization start signal.

8. The display device of claim 5, wherein the second signal generator comprises a second counter to count in response to the second gate pulse signal, and is configured to activate the second vertical synchronization start signal when the counted value of the second counter is smaller than a reference value.

9. The display device of claim 8, wherein the second counter is reset in response to the second vertical synchronization start signal.

10. The display device of claim 5, wherein the output circuit comprises:

a gate signal generator configured to generate gate signals from the pre-charge signals and the main charge signals;

a level shifter configured to boost a voltage level of the gate signals; and an output buffer configured to output the signals output from the level shifter as the gate driving signals.

11. The display device of claim 6, wherein the gate signal generator comprises a plurality of logic circuits each of which is configured to receive a corresponding pre-charge signal of the pre-charge signals and a corresponding main charge signal of the main charge signals, and to output a corresponding gate signal of the gate signals.

12. The display device of claim 5, wherein the pre-charge signals are square wave signals and the main charge signals are not square wave signals.

13. The display device of claim 1, wherein the vertical synchronization start signal comprises a first vertical synchronization signal and a second vertical synchronization signal, and the gate driver is configured to apply gate driving signals to the gate lines so as to pre-charge the pixels in response to the first pulse of the first vertical synchronization start signal and the first gate pulse signal, and to main-charge the pixels in response to the second pulse of the second vertical synchronization start signal and the second gate pulse signal.

14. The display device of claim 1, wherein, among the pixels, the pixels arranged in a same column are connected in alternating manner to a data line on one side of the column and a data line on another side of the column.

15. The display device of claim 14, wherein, while their respective pixels are driven, two data lines adjacent to each other are applied with data voltages having different polarities from each other with respect to a reference voltage.

16. A method of driving a display device, comprising:

generating pre-charge signals in response to a first pulse of a vertical synchronization start signal and a first gate pulse signal, so as to pre-charge a plurality of pixels;

generating main charge signals in response to a second pulse of the vertical synchronization start signal and a second gate pulse signal, so as to main-charge the pixels; and generating gate driving signals to be applied to gate lines;

wherein each of the gate driving signals comprises a pre-charge signal and a main charge signal, the main-charge signal beginning after the pre-charge signal ends, and wherein each of the pixels is configured to be pre-charged in response to the pre-charge signal, and to be main-charged in response to the main charge signal.

17. The method of claim 16, wherein the generating pre-charge signals further comprises:

generating a first vertical synchronization start signal in response to the first pulse of the vertical synchronization start signal and the first gate pulse signal; and generating the pre-charge signals in response to the first vertical synchronization start signal and the first gate pulse signal.

18. The method of claim 16, wherein the generating main charge signals further comprises:

generating a second vertical synchronization start signal in response to the second pulse of the vertical synchronization start signal and the second gate pulse signal; and generating the main charge signals in response to the second vertical synchronization start signal and the second gate pulse signal.

19. The method of claim 16, wherein a pulse width of the pre-charge signals corresponds to a pulse width of the first gate pulse signal, and a pulse width of the main charge signals corresponds to a pulse width of the second gate pulse signal.

20. The method of claim 19, wherein the pre-charge signals are square wave signals and the main charge signals are not square wave signals.

* * * * *